US007562969B2

(12) United States Patent
Wijshoff

(10) Patent No.: US 7,562,969 B2
(45) Date of Patent: Jul. 21, 2009

(54) INKJET PRINTHEAD AND INKJET PRINTER CONTAINING THE SAME

(75) Inventor: Hermanus M. A. Wijshoff, Grevenbicht (NL)

(73) Assignee: Oce Technologies B.V., Venlo (NL)

( * ) Notice: Subject to any disclaimer, the term of this patent is extended or adjusted under 35 U.S.C. 154(b) by 590 days.

(21) Appl. No.: 11/446,112

(22) Filed: Jun. 5, 2006

(65) Prior Publication Data

US 2006/0274115 A1 Dec. 7, 2006

(30) Foreign Application Priority Data

Jun. 6, 2005 (NL) ..... 1029190

(51) Int. Cl.
*B41J 2/045* (2006.01)

(52) U.S. Cl. ..... 347/68

(58) Field of Classification Search ..... 347/68–72
See application file for complete search history.

(56) References Cited

U.S. PATENT DOCUMENTS 6,161,925 A 12/2000 Reinten et al.
7,073,893 B2 * 7/2006 Takeuchi et al. ..... 347/68
7,367,658 B2 * 5/2008 Kusunoki et al. ..... 347/68

FOREIGN PATENT DOCUMENTS

JP 03-288647 A 12/1991
JP 2000-255055 A 9/2000

* cited by examiner

*Primary Examiner*—Lamson D Nguyen
(74) *Attorney, Agent, or Firm*—Birch, Stewart, Kolasch & Birch, LLP

(57) ABSTRACT

A inkjet printhead containing two substantially closed ink chambers separated by a wall, each of the chambers having associated therewith an electro-mechanical converter, where actuation of the converter corresponding to a first chamber of said printhead will lead to a volume change in a second chamber due to cross-talk, whereby the wall is deformable in such a way that it deforms by actuation and as such simultaneously generates a second volume change in the same chamber, either volume change being, in essence, the same size but opposite to the other.

6 Claims, 3 Drawing Sheets

INKJET PRINTHEAD AND INKJET PRINTER CONTAINING THE SAME

This application claims priority to Dutch Application No. 1029190 filed on Jun. 6, 2005 in Dutch Patent Office, the entire contents of which is hereby incorporated by reference in its entirety.

BACKGROUND OF THE INVENTION

The invention relates to an inkjet printhead comprising two substantially closed ink chambers separated by a wall, each of the chambers comprising an electro-mechanical converter, where actuation of the converter corresponding to the first chamber of said printhead will lead to a volume change in the second chamber due to cross-talk. The invention also relates to an inkjet printer comprising this printhead.

A printhead of this kind is known from U.S. Pat. No. 6,161,925. This printhead comprises a row of elongated ink chambers, also referred to as ink ducts, which by application of a machining technique have been fitted inside a so-called duct plate (element 12, see FIG. 1 of the corresponding patent). The chambers are covered by a compliant foil at the top, making them substantially closed. Furthermore, each chamber comprises an inlet opening for feeding ink into the chamber and an outlet opening (nozzle) from where individual ink drops may be ejected from each of the chambers. To this end, each of the chambers is operationally connected to a piezo-electric type electro-mechanical converter. By actuating a converter, it will expand or shrink. This movement is signaled to the chamber corresponding to this converter through the compliant foil, said chamber thus experiencing a sudden volume change. As a result, pressure waves are generated inside the chamber, under the influence of which a drop of ink may be ejected from the chamber.

In the known printhead, the converters are grouped into individual blocks, where each block comprises a carrier element on which two converters have been fitted to generate pressure waves in their corresponding chambers, as well as a support element resting on the foil at the level of the wall between the two chambers. The blocks have been fitted to a rear plate having high rigidity in a direction parallel to the chambers, and low rigidity in a direction perpendicular to the chambers. This construction is designed to prevent cross-talk. Cross-talk is the phenomenon caused by actuation of the converter corresponding to a certain chamber, producing a volume change in an adjacent chamber. This (undesired) volume change may lead to pressure waves which may adversely affect the drop ejection process in this adjacent chamber. However, in this known printhead, cross-talk is still a common occurrence. Within one block, for example, there may be a moderate power closure so that deformation of the one converter will almost certainly lead to deformation of the other converter and therefore also to a volume change in the adjacent duct. Another possible or additional cause of volume change in the adjacent chamber is that due to actuation of the converter and the associated pressure waves, the duct plate is locally stretched into a direction parallel to the direction in which the piezo-electric elements extend. This causes cross-talk between two ducts corresponding to separate blocks to also occur in the case of the known printhead.

SUMMARY OF THE INVENTION

The object of the invention is to obviate the problems described above. To this end, a printhead according to the preamble of this description has been invented, characterised in that the wall is deformable in such a way that it deforms by said actuation and as such generates a second volume change in the same chamber simultaneously with the first one, this second change being, in essence, the same size but the opposite of the first change.

This invention is based on the recognition that it will often not be possible to prevent actuation of a converter to produce a volume change in an adjacent chamber. This is because it is difficult to both achieve a full power closure between adjacent converters and prevent stretching of the chambers. The invention now comprises a deformable wall between the chambers, the above-mentioned volume change, in essence, being fully compensated due to said deformation. In the event of an increase in pressure in the first chamber, for example, the volume in the adjacent chamber may suddenly increase due to local stretching of the chambers. This volume change may be fully compensated by bending the wall towards this adjacent chamber. This bending is induced by the sudden pressure increase in the first chamber and may be tuned by the correct choice of assembly and placing of the wall. If, for example, strong deformation is desired, a very thin wall of rigid material (e.g., titanium) may be chosen, said wall being positioned pliably between the chambers. If the effects which lead to a volume change compensate each other, there will thus be a change in the shape of the adjacent chamber, but not a change in volume (which is, in point of fact, an important cause of undesired cross-talk). It should be noted that there is no net volume change in the present invention, i.e., the compensatory effect of the deformation of the wall is such that there is no volume change to potentially lead to undesirable cross-talk. Undesirable cross-talk occurs when print artefacts are produced which are visible to the naked eye. Completely contrary to the theory of known solutions, which usually try and prevent a change in shape of the walls of an adjacent chamber, the present invention shows that this change in shape may, in essence, be used to prevent a volume change of this chamber and as such, is a more important cause of undesired cross-talk.

In one embodiment, in the event of actuation of the converter which corresponds to the first chamber, the radial diameters of the second chamber, in essence, remain constant. In this embodiment, the wall is formed and placed in the printhead in such a way that it may not only prevent a net volume change of the adjacent chamber due to a compensatory deformation, but may also allow the radial diameters of the chamber (perpendicular to the length axis) to be, in essence, constant as a result of the deformation. In this respect, it is not the shape of the diameter that is referred to but the diameter as surface dimension. Practice has shown that generation of pressure waves in the adjacent chamber may thus be virtually eliminated altogether so that a further improvement occurs in preventing undesirable cross-talk. Also in this embodiment, the shape of the adjacent chamber may vary greatly by actuation of the converter corresponding to the first chamber, but as the radial diameters do not change, no ink replacement will, in essence, occur in axial direction. It will thus be possible to prevent the occurrence of pressure waves which can noticeably affect the drop ejection process.

In one embodiment, the wall has an E modulus (Young's modulus) smaller than 60 GPa. In this embodiment, the wall between the chambers is made from a relatively easily deformable material. This means that the wall can be made relatively thick without restrictions in deformability arising. The advantage of this is that it will be relatively simple to produce the element in which the chambers are formed, separated by walls. In another embodiment, the wall is, in essence, made from carbon. This material combines the special advantages of low rigidity, typically 14 Gpa, and good machinability, so that it is relatively simple to form the elements in which the chambers and walls are joined. In yet another embodiment, the wall is fitted to a carrier plate which is, in essence, made from the same type of carbon. In this embodiment, the chambers and walls may easily be made by milling the chambers from a carbon element, which automatically produces a carbon wall between the chambers. When selecting a certain type of carbon, the wall thickness and height requirements may be determined based on experiments or a model that may be applied in accordance with the present invention.

In one embodiment, the invention also relates to an inkjet printer comprising a printhead as described above. Such a printhead may be applied without producing undesirable print artefacts in a printed image.

BRIEF DESCRIPTION OF THE DRAWINGS

The present invention will now be further explained with reference to the following drawings and examples, wherein.

DETAILED DESCRIPTION OF THE INVENTION

Figure 1:
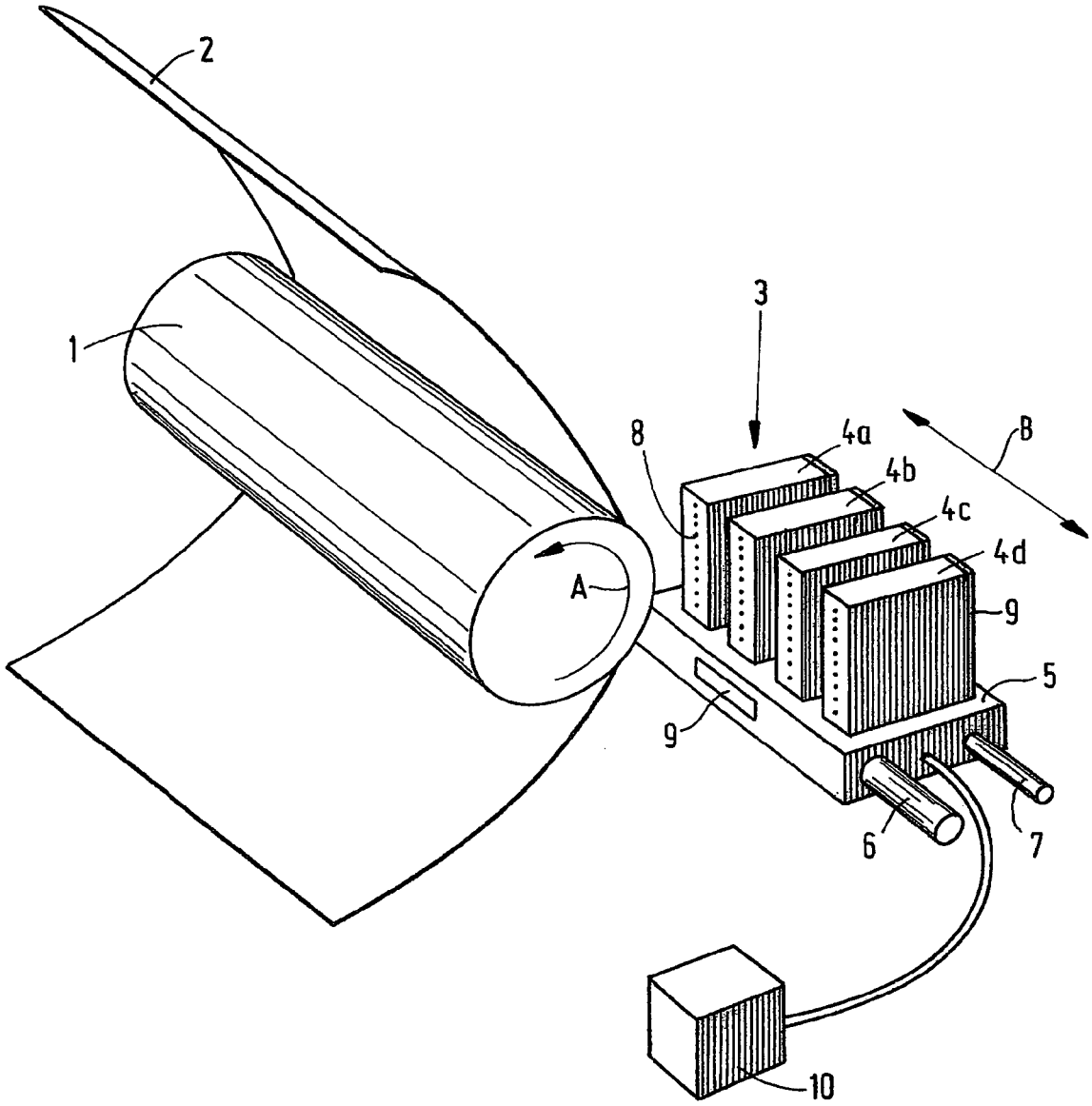
FIG. 1 shows an inkjet printer.

FIG. 1 is a diagram showing an inkjet printer. According to this embodiment, the printer comprises a roller 1 used to support a receiving medium 2, such as a sheet of paper or a transparency, and move it along the carriage 3. The carriage includes a carrier 5 to which four printheads 4*a*, 4*b*, 4*c* and 4*d* have been fitted. Each printhead contains its own color, in this case cyan (C), magenta (M), yellow (Y) and black (K) respectively. The printheads are heated using heating elements 9, which have been fitted to the rear of each printhead 4 and to the carrier 5. The temperature of the printheads is maintained at the correct level by the application of a central control unit 10 (controller).

The roller 1 may rotate around its own axis as indicated by arrow A. In this manner, the receiving medium may be moved in the sub-scanning direction (often referred to as the X direction) relative to the carrier 5, and therefore also relative to the printheads 4. The carriage 3 may be moved in reciprocation using suitable drive mechanisms (not shown) in a direction indicated by double arrow B, parallel to roller 1. To this end, the carrier 5 is moved across the guide rods 6 and 7. This direction is generally referred to as the main scanning direction or Y direction. In this manner, the receiving medium may be fully scanned by the printheads 4.

According to the embodiment as shown in FIG. 1, each printhead 4 comprises a number of internal ink chambers (not shown), each with its own exit opening (nozzle) 8. The nozzles in this embodiment form one row per printhead perpendicular to the axis of roller 1 (i.e., the row extends in the sub-scanning direction). In a practical embodiment of an inkjet printer, the number of ink chambers per printhead will be many times greater and the nozzles will be arranged over two or more rows. Each ink chamber includes a piezo-electric converter (not shown) that may generate a pressure wave in the ink chamber so that an ink drop is ejected from the nozzle of the associated chamber in the direction of the receiving medium. The converters may be actuated image-wise via an associated electrical drive circuit (not shown) by application of the central control unit 10. In this manner, an image made up of ink drops may be formed on receiving medium 2.

If a receiving medium is printed using such a printer where ink drops are ejected from ink chambers, the receiving medium, or some of it, is imaginarily split into fixed locations that form a regular field of pixel rows and pixel columns. According to one embodiment, the pixel rows are perpendicular to the pixel columns. The individual locations thus produced may each be provided with one or more ink drops. The number of locations per unit of length in directions parallel to the pixel rows and pixel columns is referred to as the resolution of the printed image, for example indicated as 400×600 d.p.i. ("dots per inch"). By actuating a row of printhead nozzles of the inkjet printer, image-wise, when it is moved relative to the receiving medium as the carrier 5 moves, an image, or some of it, made up of ink drops is formed on the receiving medium, or at least formed in a strip as wide as the length of the nozzle row.

Figure 2:
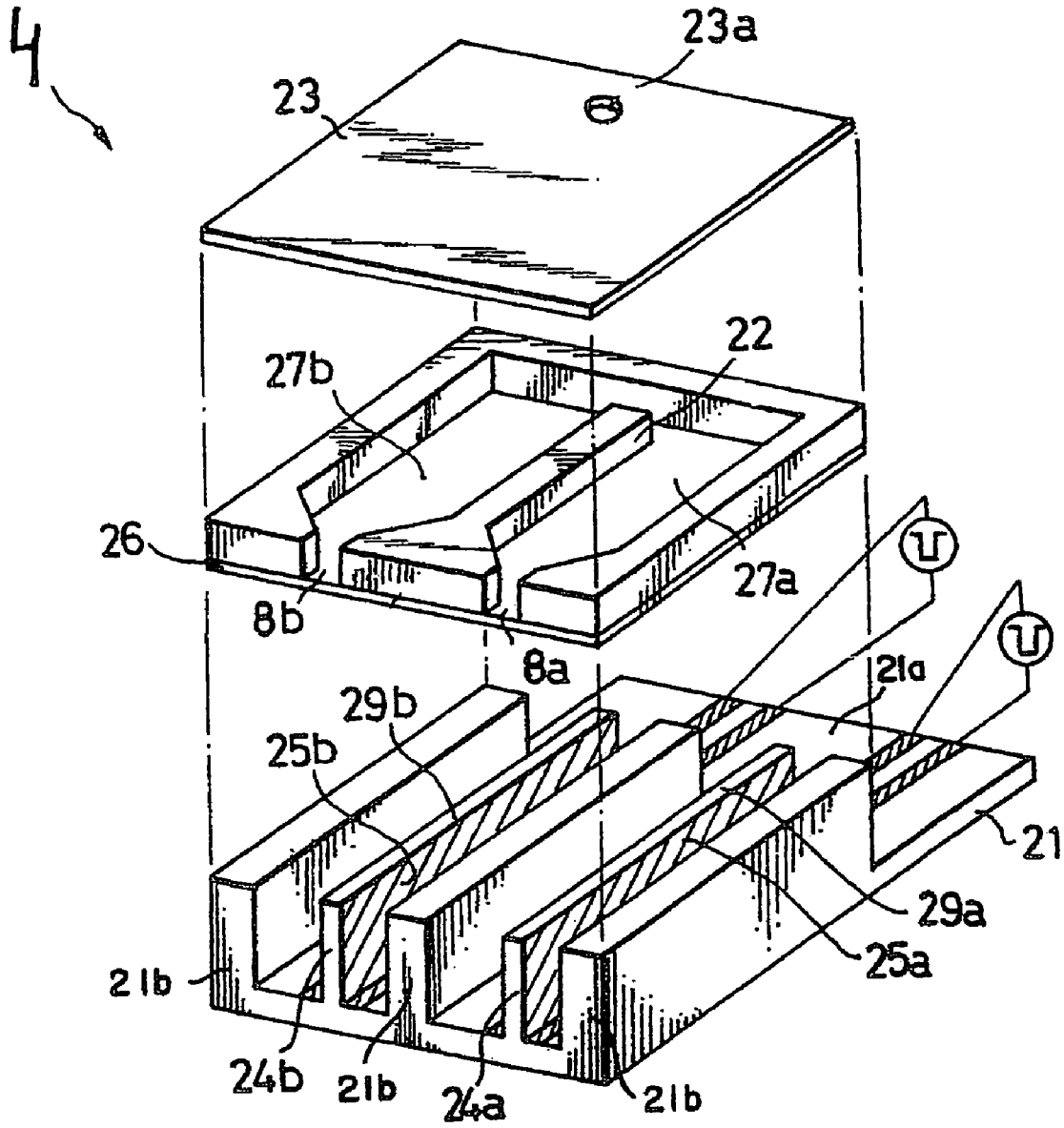
FIG. 2 is a perspective view of the duct plate with assembly.

FIG. 2 is a diagram showing an inkjet printhead 4 in which the present invention may be applied. This printhead comprises a carrier 21 having a surface 21*a* on which two piezo-electric converters 24*a* and 24*b* have been fitted. These converters may be actuated by imposing electrical pulses via electrodes 25*a* and 25*b* respectively. The carrier furthermore comprises support elements 21*b* which are involved in carrying the compliant foil 26 onto which the ink chamber structure is fitted. This foil is fitted to the tops 29*a* and 29*b* of the piezo-electric converters. In this schematic embodiment, only two ink chambers 27*a* and 27*b* have been shown for the ink chamber structure, separated by the deformable wall 22. The ink chambers open into nozzles 8*a* and 8*b*. The chambers are closed by plate 23, said plate comprising an inlet opening 23*a* which may be used for feeding ink into the chambers.

Figure 3:
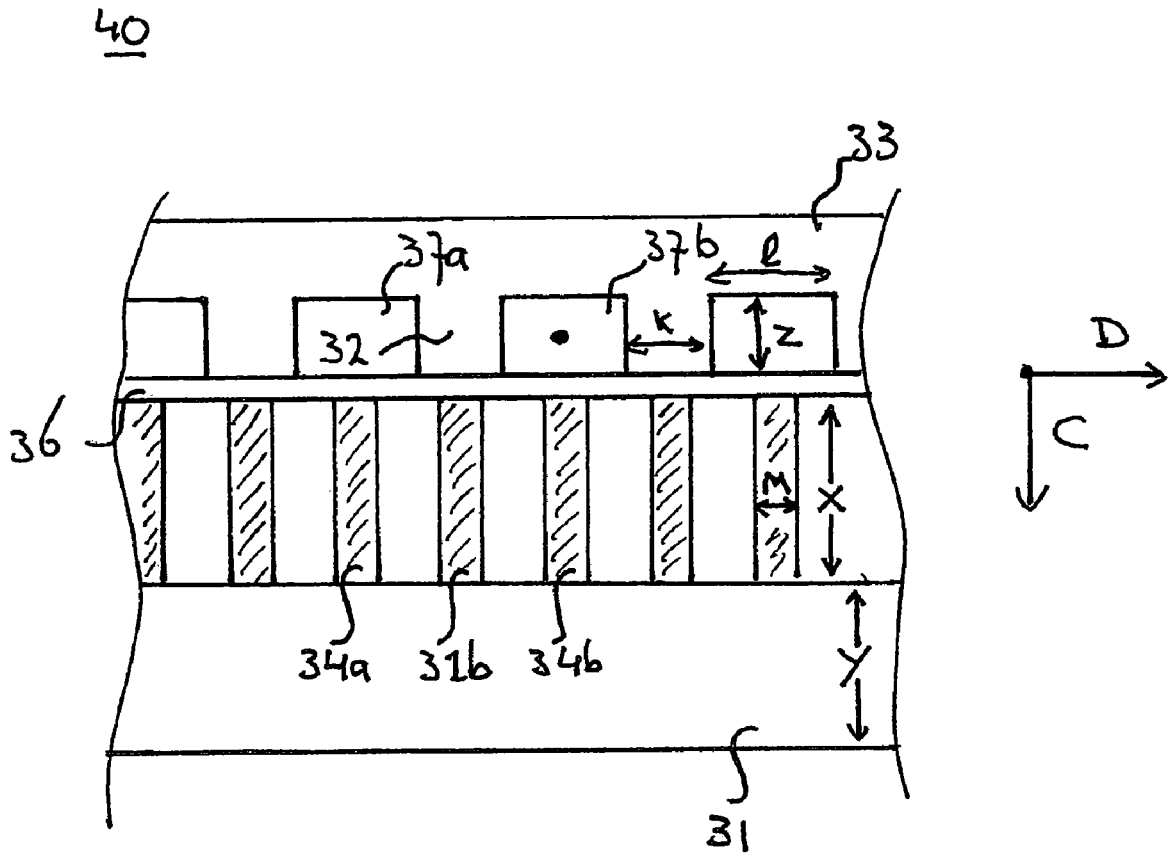
FIG. 3 shows a cross-section of the assembly with measurements and a description of the deformations (effect, bending and stretching).

FIG. 3 is a diagram showing a different embodiment of an inkjet printhead in which the present invention has been embodied. The diagram shows a cross-section of the inkjet printhead 40. In this embodiment, the printhead comprises a carrier 31 on which the converters 34*a* and 34*b* have been placed, as well as the support elements 31*b*. The carrier has a thickness y of 1 mm and has been made from Thomit 600, a ceramic aluminum and oxide containing material originating from Ceramtec from Marktredwitz (Germany). Elements 31 and 34 are multi-layer piezo-electric (generally applied PZT material) elements with a height x of 650 μm and a thickness m of 85 μm. Onto this has been fitted the compliant foil 36, which in this embodiment is a 10 μm thick Upilex polyamide foil (E modulus 9 Gpa). The ink chambers 37*a* and 37*b* are shown having a width l of 200 μm and a height z of 140 μm. These chambers are milled into a 2 mm thick carbon plate 33 producing inner walls 32 having a thickness k of 140 μm. As these walls are made from carbon, they may deform in a direction parallel to direction D as indicated. The chosen thickness k, together with the wall configuration as a component of plate 33 mean that they will deform relatively easily if the pressure inside a chamber changes.

If, for example, piezo-electric converter 34*a* is actuated, then the adjacent chamber 37*b* will be subject to a volume change by pressure waves generated as a result of this chamber being stretched in direction C as indicated (in which the piezo-electric elements extend). However, actuation also increases the pressure inside chamber 37*a*, causing the wall 32 to deform towards chamber 37*b*. The selected configuration is such that it induces a volume change in chamber 37*b*, which is (virtually) fully compensated by the above-mentioned volume change of chamber 37*b* as a result of the chamber being stretched. As such, chamber 37*b* will not be subject to a net volume change due to actuation of converter

34*a*. Practice has also shown that, in this embodiment, the radial diameters in chamber 37*b* do not change when converter 34*a* is actuated. This, in essence, prevents the occurrence of pressure waves in chamber 37*b*, so that cross-talk can be forced back even further.

In one embodiment, where a more rigid material is selected for the wall, this will need to be made thinner and/or configured differently so that it retains adequate deformability. The construction of the wall will also depend on whether full power closure will exist or not between the piezo-electric converters via carrier element 31. If there is no full power closure, then actuation of the converter which corresponds to a certain chamber will induce a volume change in an adjacent chamber that increases as the power closure deteriorates. To compensate for this volume change, the wall will therefore need to deform to a greater extent upon actuation.

The invention claimed is:

1. An inkjet printhead comprising two substantially closed ink chambers separated by a wall, each of the chambers operatively associated with an electro-mechanical converter, where actuation of the converter corresponding to the first chamber of said printhead will lead to a first volume change in the second chamber due to cross-talk, wherein the wall is deformable in such a way that it deforms by said actuation and as such simultaneously generates a second volume change in the same chamber said second volume change being substantially the same size but the opposite to the first volume change.

2. The inkjet printhead according to claim 1, wherein, in the event of actuation of the converter which corresponds to the first chamber, the radial diameters of the second chamber, in essence, remain constant.

3. The inkjet printhead according to claim 1, wherein the wall has an E modulus smaller than 60 Gpa.

4. The inkjet printhead according to claim 1, wherein the wall is, in essence, made from carbon.

5. The inkjet printhead according to claim 4, wherein the wall is fitted onto a carrier plate that is, in essence, made from the same type of carbon.

6. An inkjet printer comprising the inkjet printhead according to claim 1.

* * * * *